US005845715A

United States Patent [19]

Alhamad

[11] Patent Number: 5,845,715

[45] Date of Patent: Dec. 8, 1998

[54] INHIBITION OF HYDROCARBON VAPORS IN FUEL TANKS

[76] Inventor: Shaikh Ghaleb Mohammad Yassin Alhamad, P.O. Box 31590, Riyadh, 11418, Saudi Arabia

[21] Appl. No.: 845,677

[22] Filed: Apr. 25, 1997

Related U.S. Application Data

[63] Continuation of Ser. No. 608,942, Feb. 19, 1996, abandoned, which is a continuation of Ser. No. 333,054, Nov. 1, 1994, abandoned, which is a continuation-in-part of Ser. No. 806,901, Dec. 12, 1991, Pat. No. 5,402,852, which is a continuation of Ser. No. 674,277, Mar. 19, 1991, Pat. No. 5,097,907, which is a division of Ser. No. 417,696, Oct. 5, 1989, Pat. No. 5,001,017, which is a continuation of Ser. No. 280,317, Dec. 6, 1988, abandoned.

[51] Int. Cl.[6] ..... A62C 3/07; B65D 90/22

[52] U.S. Cl. ..... 169/66; 169/62; 169/69; 220/4.14; 220/88.1

[58] Field of Search ..... 169/45, 46, 48, 169/49, 50, 62, 66, 69; 220/88.1, 450, 4.14

[56] References Cited

U.S. PATENT DOCUMENTS

| | | | |
|---|---|---|---|
| 1,671,650 | 5/1928 | Newman et al. . | |
| 3,162,231 | 12/1964 | Emerson | 153/2 |
| 3,349,953 | 10/1967 | Conaway et al. | 220/85 |
| 3,356,256 | 12/1967 | Szego | 220/88 |
| 3,687,329 | 8/1972 | Baum | 220/26 R |
| 4,149,649 | 4/1979 | Szego | 220/88 A |
| 4,249,669 | 2/1981 | Szego | 220/216 |
| 4,265,317 | 5/1981 | Knecht | 169/50 |
| 4,361,190 | 11/1982 | Szego | 169/48 |
| 4,469,661 | 9/1984 | Schultz | 423/210.5 |
| 4,613,054 | 9/1986 | Schrenk | 220/88 R |
| 4,621,397 | 11/1986 | Schrenk | 29/61 |
| 4,927,045 | 5/1990 | Lichka | 220/88 R |
| 5,001,017 | 3/1991 | Alhamad | 428/573 |
| 5,129,544 | 7/1992 | Jacobson | 220/562 |
| 5,167,352 | 12/1992 | Robbins | 220/402 |
| 5,402,852 | 4/1995 | Alhamad . | |

FOREIGN PATENT DOCUMENTS

| | | | |
|---|---|---|---|
| 256239 | 2/1988 | European Pat. Off. . | |
| 601374 | 11/1925 | France . | |
| 2440892 | 6/1980 | France . | |
| 2602976 | 3/1988 | France . | |
| 3435457 | 4/1986 | Germany . | |
| 2028129 | 3/1980 | United Kingdom . | |
| 8500113 | 1/1985 | WIPO | 169/66 |

*Primary Examiner*—V. Lissi Mojica
*Attorney, Agent, or Firm*—Charles E. Cates; Frank T. Barber

[57] ABSTRACT

An effective method for diminishing hydrocarbon vapors in fuel tanks and thereby avoiding expensive, complicated and risky procedures for capturing purged hydrocarbon vapors during refueling. The method involves filling the fuel tank with multiple pieces of expanded metal net formed in the shape of ellipsoids, to inhibit the formation of hydrocarbon vapors and to promote condensation of such vapors as may be formed.

8 Claims, 2 Drawing Sheets

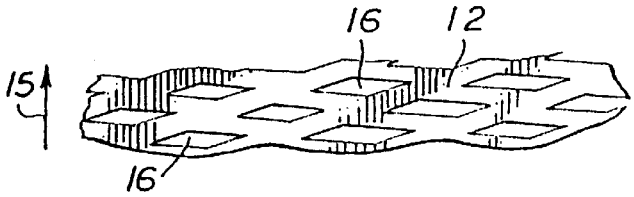
FIG. 4
FIG. 5
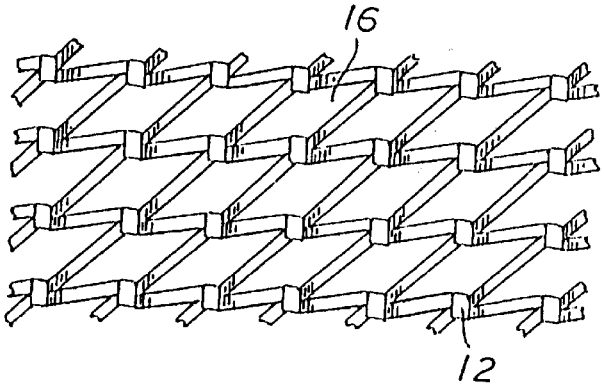
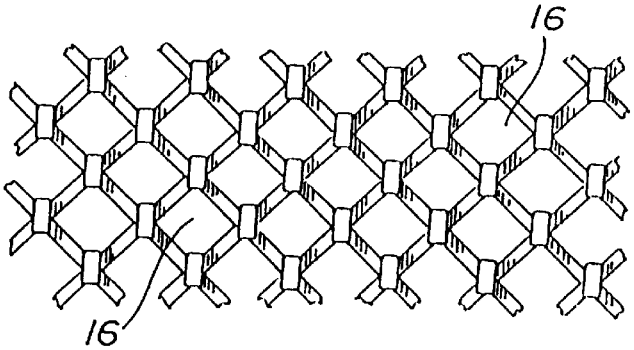
FIG. 6
FIG. 7
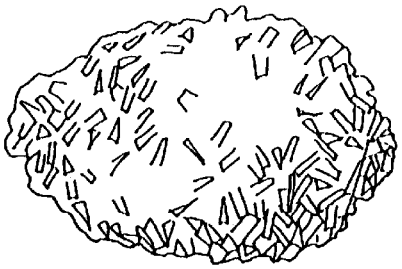

INHIBITION OF HYDROCARBON VAPORS IN FUEL TANKS

This is a continuation of application Ser. No. 08/608,942, filed on Feb. 29, 1996, abandoned which is a continuation of Ser. No. 08/333,054 filed on Nov. 1, 1994, abandoned which is a continuation-in-part of Ser. No. 07/806,901, filed Dec. 12, 1991, now U.S. Pat No. 5,402,852 which is a continuation of Ser. No. 07/674,277, filed Mar. 19, 1991, now U.S. Pat. No. 5,097,907, granted Mar. 24, 1992; which is Division of Ser. No. 07/417,696, filed Oct. 5, 1989, now U.S. Pat. No. 5,001,017, granted Mar. 19, 1991, which is a continuation of Ser. No. 07/280,317, filed Dec. 6, 1988, abandoned.

BACKGROUND AND PRIOR ART

The present invention relates to a method for inhibiting the formation of hydrocarbon vapors in the empty space above the fuel level in hydrocarbon fuel tanks. The invention has special application to automobile or other vehicles which carry on-board gasoline tanks, and to preventing the purging of hydrocarbon vapors into the atmosphere during the refueling of such tanks.

It is known that, during the normal operation of a hydrocarbon-fueled automobile, hydrocarbon vapors are generated and collect in the open space above the fuel level in the fuel tank. As the fuel is used, and the space above the fuel level increases, greater quantities of the hydrocarbon vapors are collected. The vapor generation is caused by the motion of the vehicle and the resultant vibration and sloshing of fuel in the tank, which in turn causes excitation of fuel molecules and the release of hydrocarbon vapors into the empty air space in the tank above the fuel level.

When the vehicle is refueled, the new supply of liquid fuel which is introduced into the tank replaces the hydrocarbon vapors, which are in turn purged into the atmosphere surrounding the refueling station. Also, the forceful stream of fuel being introduced into the tank causes a further agitation of the fuel and the generation of additional quantities of hydrocarbon vapors which are added to those being purged to the atmosphere.

These very substantial quantities of fugitive hydrocarbon vapors have been linked to the degradation of local air quality, giving rise to episodes of high ozone and smog and presenting a substantial danger to the environment and to personal health. The problem has been the subject of considerable technical and legal debate.

One solution that has been thoroughly investigated is that of capturing the hydrocarbon vapors purged from the auto tank during refueling, and storing such vapors in a large plastic on-board canister containing charcoal pellets. However, the new fire and explosion risks that are posed by the presence of a large canister carrying hydrocarbon vapors has resulted in even further technical and legal debate. The studies that have been conducted leave no doubt that the fire and explosion risks will be increased if such canisters are made mandatory in autos. Further, the canisters will be effective only if the contained vapors can be continuously downloaded and introduced into the auto's carburetor for consumption in the operation of the engine. However, this further burden on the already complex carburetion system represents another downside factor to be considered.

An alternative to the on-board canister is to use a specially designed fuel pump hose to capture the fugitive vapors and store them in a canister or other container at the pump site until they can be disposed of. Although millions of dollars have been expended in researching and developing this alternative, the approach remains unattractive in view of the risk of explosion of the canisters at the fuel pump and the need for expenditure of tens of thousands of dollars to install the system in each of the gas stations throughout the country.

As the latest development, in spite of the risks inherent in the on-board canister, the decision has been made to adopt this alternative, and the U.S. Environmental Protection Agency, under provisions of 1990 Clean Air Act Amendments, has been directed to issue a rule mandating that all new U.S.-manufactured cars be equipped with an on-board refueling vapor recovery system. (Kirkbride, R. et al, "Fuel Vapor Canister Fire Simulation Tests", Final Report from the Vehicle Research and Test Center to the National Highway Traffic Safety Administration, VRTC-71-0211, Jul. 1991.)

It is the object of the present invention to provide a way of avoiding the need for adopting either of the risky, complicated and expensive alternatives outlined above.

It is another object of the invention to provide a system which inhibits the formation of hydrocarbon vapors in vehicle fuel tanks and therefore removes the source of the problem which has been described.

It is a further object to provide a hydrocarbon vapor suppression system which is durable, simple and inexpensive to manufacture and install, and relatively maintenance-free.

Other objects and advantages will become apparent as the specification proceeds.

SUMMARY OF THE INVENTION

According to the present invention, the formation of hydrocarbon vapors in the empty space above the fuel level in a fuel tank is inhibited by the steps of filling the tank with multiple pieces of expanded metal net formed in the shape of ellipsoids, and maintaining the tank full of said ellipsoids during the use thereof.

The ellipsoids dampen the vibration of the fuel caused by operation of the engine and suppresses the sloshing of the fuel caused by the vehicle motion as well as the refueling agitation, and as a result the excitation of the fuel molecules is suppressed, and substantial inhibition of the production of hydrocarbon vapors is achieved. Further, to the extent that some small quantities of vapors are generated, the special honeycomb structure of the ellipsoids filling the entire tank provides a significant surface area on which the said vapors will condense and be returned to the body of liquid fuel. Through this combined suppression and demisting capability, the installed ellipsoids provide an effective means of keeping hydrocarbon vapor levels low enough to avoid problems with the environment and personal health.

The invention is especially effective if the ellipsoid are made from magnesium alloy foil and have a specific internal surface area greater than about 170 $ft^2$ per $ft^3$.

The ellipsoids in the fuel tank not only provide the substantial diminishing of hydrocarbon levels, as described above, but are also effective in protecting the fuel tank against explosion and fire in the case of collision.

BRIEF DESCRIPTION OF THE DRAWINGS

FIGS. 3 through 6 are top views of the expanded metal net, showing the changes in configuration as the slitted sheet is pulled to open up the expanded metal net.

FIG. 7 is a perspective view showing the ellipsoid form made from the expanded metal net, for use in the present invention.

DETAILED DESCRIPTION OF THE INVENTION

Figure 1:
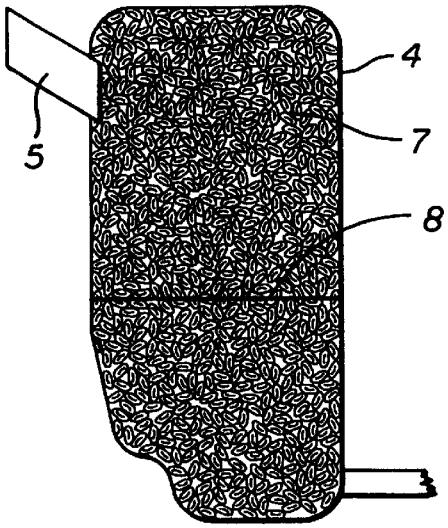
FIG. 1 is a cross-sectional view of a vehicle gas tank filled with ellipsoids made from expanded metal net, as in the present invention.

Referring to the drawings, the basic structure of the fuel container of the present invention is shown in FIG. 1, wherein the container 4, having inlet and outlet openings 5 and 6 respectively, is filled with ellipsoids 7 formed from expanded metal net. The special shape of the ellipsoids enable them to nestle together in an effective gap-free configuration. The line 8 indicates the fuel level in a tank which is approximately half full of fuel, leaving an empty space above the fuel level where hydrocarbon vapors emitting from the liquid fuel would ordinarily collect if not inhibited by the presence of the ellipsoids 7 as in the present invention.

Figure 2:
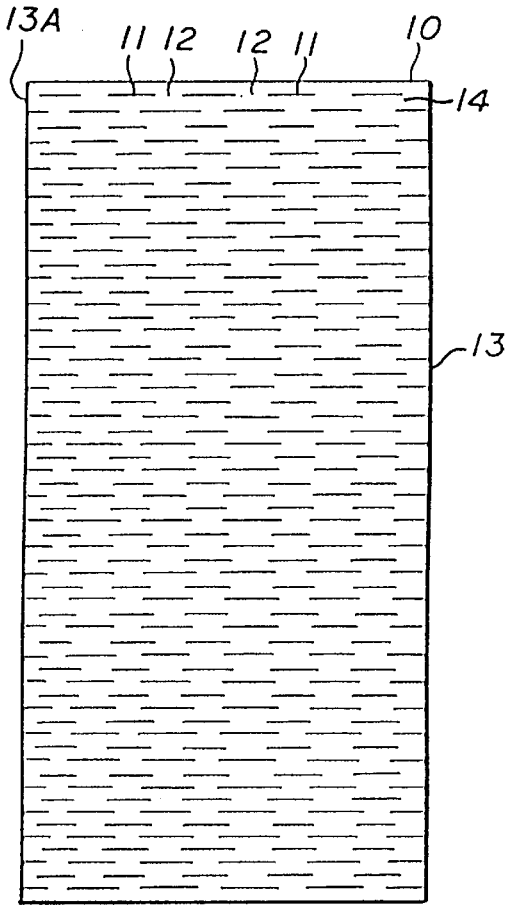
FIG. 2 is a top view of a slitted magnesium alloy foil sheet, which can be expanded by stretching to provide the expanded metal net usable in the present invention.

The expanded metal employed in producing the ellipsoids soids 7 is formed by slitting a continuous sheet of foil in a specialized manner and then stretching the slitted sheet to convert it to an expanded prismatic metal net having a thickness substantially greater than the thickness of the foil. Referring to the drawings, FIG. 2 shows a sheet of metal foil 10 provided with discontinuous slits appropriate for the present invention. The length and width of the sheet may be chosen from any number of practical dimensions, depending on the properties of the ellipsoids desired to be produced.

As noted in FIG. 2, sheet 10 is provided with discontinuous slits 11 in spaced apart lines which are parallel to each other but transverse to the longitudinal dimension of the sheet 10. The slits 11 in each line are separated by unslit segments or gaps 12, and it will be noted that the slits 11 in each line are offset from the slits 11 in adjacent lines. Similarly, the gaps 12 in each line are offset from the gaps 12 in adjacent lines. The lines of slits run perpendicular to the longitudinal edges 13 and 13A of the continuous sheet of metal foil. Methods and apparatus for producing the slitted metal foil are described in detail in U.S. Pat. No. 5,095,597, dated Mar. 17, 1992 and U.S. Pat. No. 5,142,735, dated Sep. 1, 1992.

Figure 3:
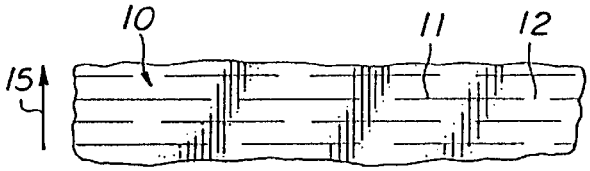

When the slitted metal foil as shown in FIG. 2 is stretched by subjecting it to longitudinal tension, it is converted into an expanded metal prismatic net, usable in forming the ellipsoids 7 of the present invention. In the stretching procedure, the horizontal surfaces of foil are raised to a vertical position, taking on a honeycomb-like structure. This conversion is shown in FIGS. 3 through 6 of the drawings. The slitted metal foil 10 is shown in FIG. 3 prior to stretching. When longitudinal tension is applied in the direction of arrow 15, the slits 11 begin to open and are converted to eyes 16, and the product assumes the appearance shown in FIG. 4. The application of more tension causes a greater opening of the slits, and the product expands into the honeycomb-like, prismatic form shown in FIG. 5. When even further tension is applied, the configuration reaches its desired end point, as in FIG. 6. The conversion illustrated in FIGS. 3 through 6 is accompanied by an increase in thickness of the product, the final thickness of the honeycomb product being approximately twice the value of the space 14 between each line of slits. Each eye of the expanded sheet has a three-dimensional structure having eight corner points.

The ellipsoids 7 are produced by cutting the expanded metal net sheets 4 or 5 into small segments which are then mechanically formed into small ellipsoids, as illustrated in FIG. 7. The ellipsoids 7 generally have a short diameter in the range of 20 to 30 mm, and a long diameter in the range of 30 to 45 mm, with the distance between focal points measuring approximately two-thirds of the long diameter of the ellipsoid. Their ellipsoid shape causes them to nestle closely together when placed in a contained position, so that gaps are avoided and the combined ellipsoid structure within the tank can achieve a maximum specific internal surface area. Apparatus for producing these ellipsoids is described in detail in U.S. Pat. No. 5,207,756, dated May 4, 1993.

For the hydrocarbon vapor suppression usage of the present invention, it is desired that the metal foil be very thin and that the slits in each line and the spaces between the lines be very small. Thus, the thickness of the foil used to produce the metal net should be in the range between 0.028 and 1.0 mm, and the preferred thickness is between 0.2 and 1.0 mm. The length of each slit 11 is in the range between 1 and 2.5 cm, and the unslit sections or gaps 12 between each slit are in the range between 2 to 6 mm long. The distance separating lines of slits may be varied, on the thickness desired for the resulting expanded metal net. The distance 14 is ordinarily in the range between 1 and 4 mm, so that the thickness of the resulting expanded metal net is normally in the range between about 2 and 8 mm. The preferred value for distance 14 is either 1 mm or 2 mm.

The kind of metal used in the metal foil is preferably an alloy of magnesium with suitable compatible substances. Thus, for example, it is desirable to use an alloy of magnesium with substances such as aluminum, copper, zirconium, zinc, strontium, Rn(electron), silicon, titanium, iron, manganese, chromium, and combinations thereof. Alloys such as the above have the valuable characteristic of not only being lightweight, strong, elastic, heat-conductive, etc., but also the important characteristic of being nonflammable at high temperatures. A particularly useful combination is the alloy of magnesium with aluminum and copper. Another preferred combination is the alloy of magnesium with zirconium and strontium. The invention is illustrated in a specific example by an alloy comprising 0.25% Si, 0.3% Fe, 0.01% Cu, 0.01% Mn, 10% Al, 0.1% Zn, 0.08% Ti, and the remainder Mg. Such a product possess tensile strength of 300 N/mm, proof stress of 200 n/mm, elongation of 10%, and Brinell hardness of (5/250–30).

For certain uses, the expanded metal foil used in the present invention may be combined with other materials. For example, if the foil is coated with an alkaline bichromate, the resulting expanded metal net acts as a corrosion inhibitor, since the bichromate acts to remove water from fuels and their containers. Further, if the metal foil is combined with oleates or similar compounds, the fire extinguishing capability of the expanded metal net is enhanced, since the oleate emits a dense vapor which assists in smothering the flame.

In the practice of the invention, the ellipsoids described above are filled into the fuel tank of a vehicle. If the fuel tank is completely filled with the ellipsoids, a large amount of fuel can still be added to the tank, to occupy the interstices in the metal nets from which the ellipsoids are made. As a preferred feature of the invention, it is desired that the tank be completely filled with the expanded metal net material but at the same time the volume of the actual metal itself be kept in the range of about 0.4 to 1.1% of the volume of the tank. That is, when the tank is filled with the expanded metal net ellipsoids, the tank will still have a remaining capacity of 98.9 to 99.6% for fuel.

For optimum results in inhibiting the production of hydrocarbon vapors, and especially in causing condensation of such vapors as may be produced, the ellipsoids should have a specific internal surface area greater than about 170 $ft^2$ per $ft^3$. A preferred range for the specific internal surface area is between about 300 and 340 $ft^2$ per $ft^3$. Higher values would be of some benefit, if the manufacturing techniques were capable of achieving the same.

It is a feature of the invention that the very small size of the ellipsoids make them uniquely useful for filling tanks, especially those having small inlet openings. Thus, even for the retrofitting of existing auto tanks, it is not necessary to dismantle the tanks in order to install the ellipsoids. They may be merely poured in through the inlet opening.

Although preferred embodiments of the invention have been described herein in detail in connection with applications in the automotive environment, it will be understood by those skilled in the art that the invention is equally applicable in other industrial and commercial situations, where variations may be applied without departing from the spirit of this invention.

What is claimed is:

1. A method for inhibiting the formation of hydrocarbon vapors in a fuel tank containing a body of fuel partially filling said tank and having an empty space above said fuel, comprising the steps of filling said tank with multiple pieces of expanded metal net in the shape of ellipsoids having unequal major and minor axes to provide a metal net filling having an internal surface area greater than about 170 $ft^2$ $ft^3$ and maintaining said tank full of said ellipsoids during the use thereof, whereby the formation of hydrocarbon vapors as may be formed are condensed to a liquid.

2. The method of claim 1 wherein the short diameter of said ellipsoids is in the range of 20 to 30 mm and the long diameter is in the range of 30 to 45 mm.

3. A vehicle on-board container adapted for inhibiting the formation of hydrocarbon vapors therein, said container comprising a tank, a supply of hydrocarbon fuel therein, and multiple pieces of expanded metal net filled therein, said pieces being formed in the shape of ellipsoids having unequal major and minor axes and comprising a filling of ellipsoids having an internal surface area of more than 300 $ft^2$ $ft^3$, whereby the formation of hydrocarbon vapors in said container is inhibited.

4. The method of claim 1 wherein the volume of said metal occupies from 0.4 to 1.1% of the volume of the said tank.

5. The method of claim 1 wherein the said expanded metal net is made from magnesium alloy foil having a thickness in the range from about 0.02 to 1.0 mm.

6. The container of claim 3 wherein the volume of said metal occupies from 0.4 to 1.1% of the volume of the said tank.

7. The container of claim 3 wherein the said expanded metal net is made from magnesium alloy foil having a thickness in the range from about 0.02 to 1.0 mm.

8. The container of claim 3 wherein the short diameter of said ellipsoids is in the range of 20 to 30 mm and the long diameter is in the range of 30 to 45 mm.

* * * * *